US010370168B1

(12) United States Patent
Kimchi et al.

(10) Patent No.: US 10,370,168 B1
(45) Date of Patent: Aug. 6, 2019

(54) MULTI-CHAMBER PACKAGING DEVICES

(71) Applicant: Amazon Technologies, Inc., Seattle, WA (US)

(72) Inventors: Gur Kimchi, Bellevue, WA (US); Ricky Dean Welsh, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 531 days.

(21) Appl. No.: 15/193,882

(22) Filed: Jun. 27, 2016

(51) Int. Cl.
*B65B 31/00* (2006.01)
*B65D 81/05* (2006.01)

(52) U.S. Cl.
CPC ..... *B65D 81/052* (2013.01); *B65B 31/00* (2013.01)

(58) Field of Classification Search
CPC .. B65D 81/052; B65D 81/05; B65D 81/2023; B65B 31/00
USPC ..... 206/524.8, 522, 583, 591, 521
See application file for complete search history.

(56) References Cited

U.S. PATENT DOCUMENTS 4,640,080 A * 2/1987 Wright ..... B65D 81/09 206/521
4,949,530 A * 8/1990 Pharo ..... B65D 81/03 53/449
5,272,856 A * 12/1993 Pharo ..... B65D 81/052 53/403
5,588,532 A * 12/1996 Pharo ..... B65D 81/052 206/522
5,788,078 A * 8/1998 Fuss ..... B65B 9/15 206/521
6,513,658 B1 * 2/2003 Adkins ..... B65D 81/052 206/522
6,571,954 B2 * 6/2003 Nadler ..... B65D 81/03 206/522
8,281,928 B2 * 10/2012 Smith ..... B65D 81/052 206/522
2010/0282824 A1 * 11/2010 Kannankeril ..... B31D 5/0073 229/68.1
2012/0112481 A1 * 5/2012 ten Thoren ..... B66C 1/108 294/67.1
2014/0224699 A1 * 8/2014 Smith ..... B65B 5/06 206/522

* cited by examiner

*Primary Examiner* — Chun Hoi Cheung
(74) *Attorney, Agent, or Firm* — Kilpatrick Townsend & Stockton LLP

(57) ABSTRACT

A multi-chamber device is described. The device can include a first chamber and a second chamber disposed within the first chamber. Each chamber may be formed from a flexible material. A first tube may extend between the first chamber and outside the first chamber to enable addition of gas to the first chamber. A second tube may extend between the second chamber and outside the first chamber to enable removal of gas from the second chamber.

20 Claims, 10 Drawing Sheets

MULTI-CHAMBER PACKAGING DEVICES

BACKGROUND

Goods can be shipped using postal services, courier services, and other similar services. To minimize the likelihood of damage to the goods during transit, the goods can be packaged using packing materials such as cardboard boxes, plastic mailing sleeves, plastic bubble wrap, foam peanuts, and other similar materials. In some cases, similar packing materials may also be used as part of storing the goods in warehouse, inventory processing centers, and other similar locations.

BRIEF DESCRIPTION OF THE DRAWINGS

Various embodiments in accordance with the present disclosure will be described with reference to the drawings, in which.

DETAILED DESCRIPTION

Figure 1:
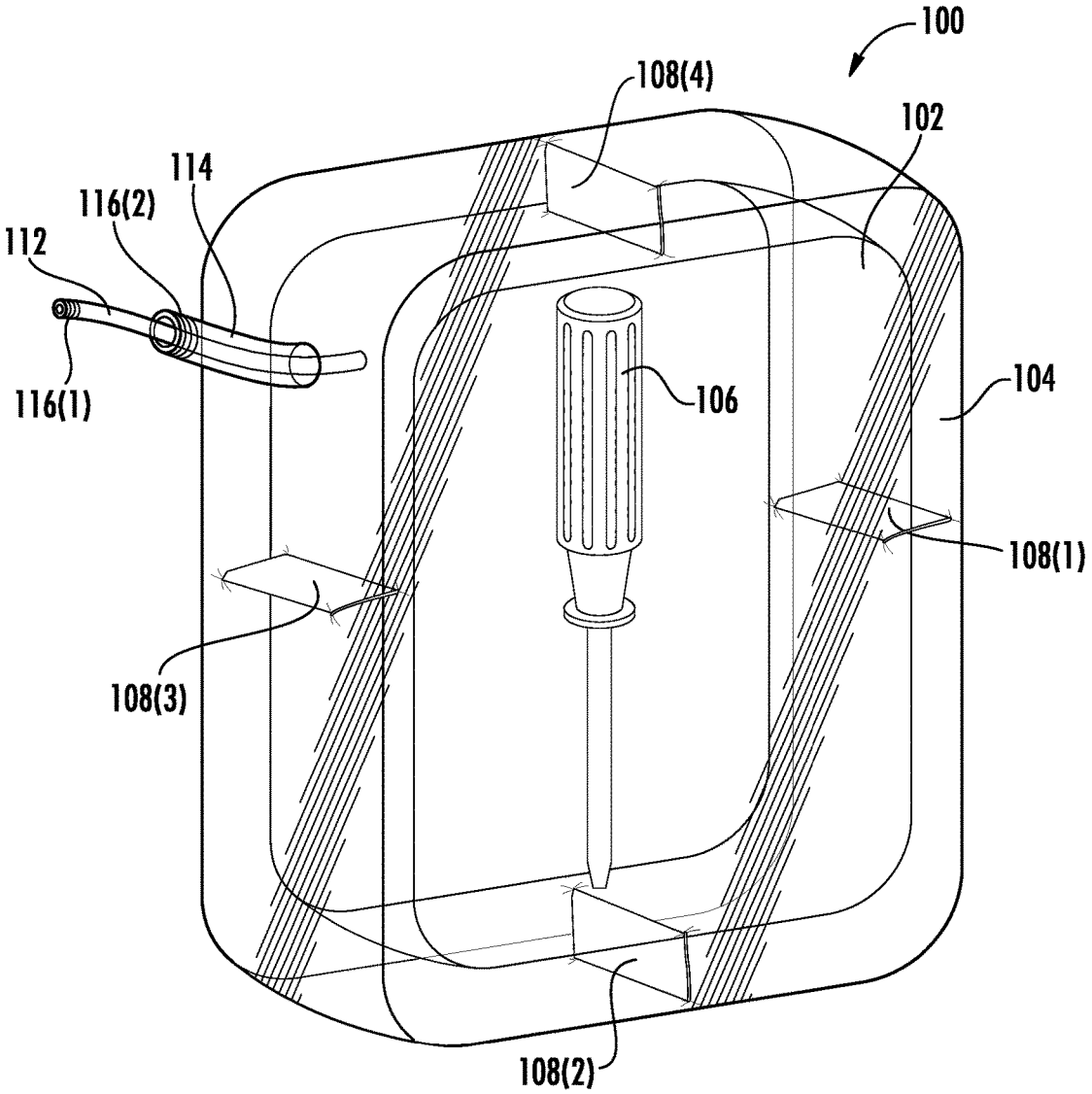
FIG. 1 illustrates a multi-chamber packaging device in a first state, in accordance with at least one example.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Examples of the present specification are directed to, among other things, multi-chamber packaging device and methods for using the multi-chamber packaging device. An example multi-chamber packaging device described herein may include a cushion chamber or bladder and a retention chamber or bladder within the cushion chamber. Each chamber may be independently inflatable and deflatable using one of two tubes or valve stems. The retention chamber can be used to hold a good during storage and shipment of the good. For example, after the good has been placed in the retention chamber, air may be drawn out of the retention chamber such that the retention chamber collapses around the good. In some examples, air may also be drawn out of the cushioning chamber. Removing air from one or more chambers may reduce the volume required for storing and transporting the good as compared to traditional packing techniques (e.g., boxes, mailers, air pillows, etc.). Air may be pumped into the cushion chamber such that the cushion chamber expands around the retention chamber. In this manner, the retention chamber may retain the good and the cushion chamber may cushion the good. Such cushioning may be desirable during storage of the good (e.g., in a warehouse) and during shipment of the good (e.g., delivery of the good to a recipient).

Depending on the implementation, the chambers of the multi-chamber packaging device can be repeatedly inflated and deflated during the life of the multi-chamber packaging device. Multi-chamber packaging devices, as described herein, may be used in place of traditional packing materials such as cardboard boxes, packing peanuts, mailers, air pillows, and the like. In this manner, use of the multi-chamber packaging devices, as compared to traditional packing materials, may reduce storage volume, shipping volume, and shipping costs and may also minimize waste production. The multi-chamber packaging devices, in some examples, may be reusable and/or recyclable. For example, a user who receives an item packaged in a multi-chamber packaging device may use the same packaging device to return the item to the sender. Once the packaging device is received from the user, the sender may recycle the packaging device.

Turning now to a particular example, in this example, a multi-chamber packaging device is provided. The multi-chamber packaging device can include two chambers, an outer chamber and an inner chamber located within the outer chamber. A first valve may extend from the inner chamber to outside the device. The first valve can be used to add and remove air from the inner chamber. A second valve may extend from the outer chamber to outside the device. The second valve can be used to add and remove air from the outer chamber. After an item has been placed in the inner chamber (e.g., through openings in the inner chamber and the outer chamber), the first valve of the device can be used to remove air from the inner chamber. In practice, removing air from the inner chamber may collapse an interior surface of the inner chamber around the item. Also after the item has been placed in the inner chamber, the second valve of the device can be used to add air to the outer chamber. In practice, adding air to the outer chamber may expand the outer chamber and provide a layer of air cushioning. This layer may lie between an outer layer of the outer chamber and an outer layer of the inner chamber (also an inner layer of the outer chamber). The outer chamber (and the inner chamber) can be deflated and inflated at different times while the packaging device, including the item, is being stored (e.g., in a warehouse), delivered (e.g., in transit), and otherwise processed.

Figure 2:
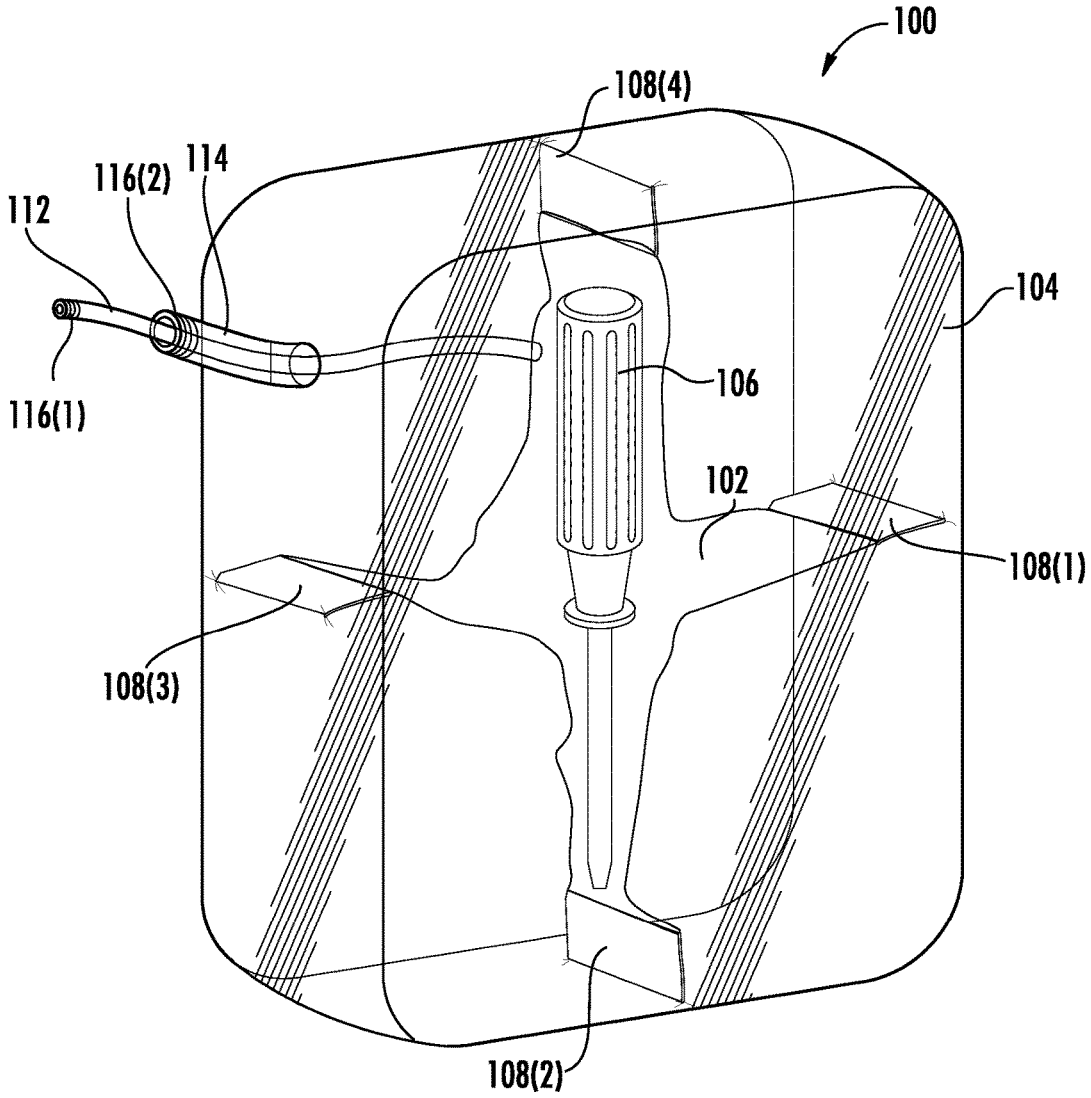
FIG. 2 illustrates the multi-chamber packaging device of FIG. 1 in a second state, in accordance with at least one example.

Turning now to the Figures, FIG. 1 and FIG. 2 illustrate a multi-chamber packaging device 100, in accordance with at least one example. The multi-chamber packaging device 100 can include an inner chamber 102 and an outer chamber 104. The inner chamber 102 can be disposed within the outer chamber 104. Thus, the inner chamber 102 may occupy a portion of the volume within the outer chamber 104. The inner chamber 102 and the outer chamber 104 may each be independently inflatable and deflatable. Thus, in FIG. 1, the multi-chamber packaging device 100 is illustrated with the inner chamber 102 in an inflated state and the outer chamber 104 in an inflated state. And, in FIG. 2, the multi-chamber packaging device 100 is illustrated with the inner chamber 102 in a deflated state and the outer chamber 104 in the inflated state.

In some examples, the outer chamber 104 may be formed from one or more pieces of flexible material. For example, the outer chamber 104 may be formed from a single piece of material and include one or more seams where edges of the piece of material are connected. In some examples, the inner chamber 102 may be formed from one or more pieces of flexible material. The inner chamber 102 may be dimensioned to receive an item 106 (e.g., any physical item). In FIGS. 1 and 2, the item 106 is illustrated as a screwdriver. Depending on the configuration of the multi-chamber packaging device 100, the item 106 may be placed in the inner chamber 102 prior to the inner chamber 102 being placed in the outer chamber 104. In some examples, the inner chamber 102 may be formed around the item 106 and sealed around the item (e.g., include one or more seams or sealed edges). In some examples, the item 106 may be placed in the inner chamber 102 via openings in the inner chamber 102 and/or the outer chamber 104. For example, the item 106 may be placed in the inner chamber 102 via an inner tube (or inner valve stem) 112.

The inner tube 112 extends from the inner chamber 102 through the outer chamber 104 to outside the outer chamber 104. Thus, the inner tube 112 may be used to move air into and out of the inner chamber 102. An outer tube (or outer valve stem) 114 extends from the outer chamber 104 to outside the outer chamber 104. Thus, the outer tube 114 may be used to move air into and out of the outer chamber 104. In some examples, each of the inner tube 112 and the outer tube 114 may include a valve 116. For example, the inner tube 112 may include an inner valve 116(1) and the outer tube 114 may include an outer valve 116(2). The valves 116 may include any suitable valve capable of retaining a positive pressure and/or a negative pressure in the chambers 102, 104. For example, the valves 116 may include Presta valves (e.g., a device including an outer valve stem with an inner valve body), Schrader valves (e.g., a device including a valve stem with an inner poppet valve core), needle air valves typically used in footballs and soccer balls, plastic air valves including press-fit enclosures and/or one-way membranes such as those typically used on beach balls and other inflatable products, air valves including threaded enclosures and/or one-way membranes such as those typically used on air mattresses, and any other suitable valves. In some examples, the inner valve 116(1) is configured to hold a negative pressure in the inner chamber 102 and the outer valve 116(2) is configured to hold a positive pressure in the outer chamber 104. As illustrated, the inner tube 112 may be disposed within the outer tube 114. The inner tube 112 and the outer tube 114 may be flexible in order to receive the item 106. As discussed elsewhere herein, instead of placing the item into the inner chamber 102 via the inner tube 112 and the outer tube 114, the item 106 may be placed in the inner chamber 102 at the time when the inner chamber 102 and/or the outer chamber 104 are formed.

The multi-chamber packaging device 100 may have any suitable shape. For example, in FIG. 1, the inner chamber 102 and the outer chamber 104 are illustrated as being rectangular. It should be understood, however, that the inner chamber 102 and the outer chamber 104 can have any suitable uniform or non-uniform shape. For example, the inner chamber 102 and the outer chamber 104 may be spherical, cubic, and the like. In some examples, the inner chamber 102 and/or the outer chamber 104 may be sized to correspond to an item that will be placed in the inner chamber 102. For example, the shape of the inner chamber 102 may correspond to the shape of a non-uniform-shaped item. This may be desirable to ensure that the inner chamber 102 can be deflated to conform to the non-uniform-shaped item.

The inner chamber 102 may be held at a particular position within the outer chamber 104 by one or more webs **108(1)-108(*n*). The webs 108 may be formed in the outer chamber 104 to provide structural support to the outer chamber 104 and fix the position of the inner chamber 102 within the outer chamber 104. For example, the webs 108 may be disposed about a center point of the outer chamber 104 and extend between walls of the inner chamber 102 and walls of the outer chamber 104. In some examples, the webs 108 may be included on each of the six sides of the inner chamber 102** (e.g., top surface, bottom surface, and four side surfaces).

In some examples, the webs 108 may extend continuously around the inner chamber 102. In this manner, the webs 108 may include openings that correspond to the inner chamber 102. The inner chamber 102 may be attached to edges of the opening formed in the webs 108. For example, an opening of the web 108 can be sized slightly larger than the outside dimensions of the inner chamber 102. From the opening, the material of the web 108 may extend away in all directions until it intersects the wall of the outer chamber 104. This material may be attached to wall of the outer chamber 104. The webs 108 may be laid out in an array about the center point of the outer chamber 104. For example, the multi-chamber packaging device 100 may include four webs 108, with the outer edge of each of the webs 108 attached to the wall of the outer chamber 104 all the way around the web 108 (e.g., all 360 degrees). In some examples, more or less webs 108 are included and aligned differently.

In some examples, the inner chamber 102 may be held within the outer chamber 104 by using strings, cables, cords, or the like that connect walls of the inner chamber 102 with walls of the outer chamber 104. For example, each cord may have a uniform length and may be disposed uniformly around the inner chamber 102. In this manner, the inner chamber 102 may be held by the cord in the center of the outer chamber 104. In some examples, the webs 108, the cords, and other similar structures may be considered retention elements used to retain the inner chamber 102.

As illustrated in FIG. 2, after the item 106 has been placed in the inner chamber 102, air or other gas may be removed from the inner chamber 102. This may case the walls of the inner chamber 102 to collapse around the item 106 and hold the item 106. The air or other gas may be removed from the inner chamber 102 via the inner tube 112. As the inner tube 112 may also include the inner valve 116(1), the inner valve 116(1) may function to keep unwanted air or gas from moving between the inner chamber 102 and outside the multi-chamber packaging device 100. As also illustrated in FIG. 2, after the inner chamber 102 has been deflated or in conjunction with the inner chamber 102 being deflated, the outer chamber 104 may be inflated. This may be achieved by adding air or other gas to the outer chamber 104 via the outer tube 114. This may create an air cushion between the item 106 held in the inner chamber 102 and the outer wall of the outer chamber 104. As the outer tube 114 may also include the outer valve 116(2), the outer valve 116(2) may function to keep unwanted air or gas from moving between the outer chamber 104 and outside the multi-chamber packaging device 100.

To access the item 106 within the multi-chamber packaging device 100, the outer chamber 104 and the inner chamber 102 may be punctured, torn, or otherwise opened. In some examples, the multi-chamber packaging device 100 may include a ripcord or other structure to enable the chambers 102, 104 to be quickly and easily opened. In some examples, the item 106 may be accessed via the tubes 112, 114.

In some examples, the multi-chamber packaging device 100 may include an area on its exterior surface where a delivery label may be applied. For example, the delivery label may be attached to the exterior surface using an adhesive on the backside of the label. In some examples, instructions relating to delivery (e.g., a delivery address, handling instructions, contents, etc.) may be printed directly on the exterior surface of the multi-chamber packaging device 100 or on the delivery label.

The multi-chamber packaging device 100 can be formed from any suitable flexible material that is also capable of holding positive and/or negative pressure. Examples of such material may include, but are not limited to, rubber, polyester, latex, nylon, foil, elastomers, polyethylene materials (e.g., MYLAR or biaxially-oriented polyethylene terephthalate), other plastics, and any other suitable materials. In some examples, the flexible material may be recyclable. Any suitable gas may be used to fill the multi-chamber packaging device 100. Examples of such gases may include, but are not limited to, air, heated air, cooled air, helium, hydrogen, and other suitable gases.

Figure 3:
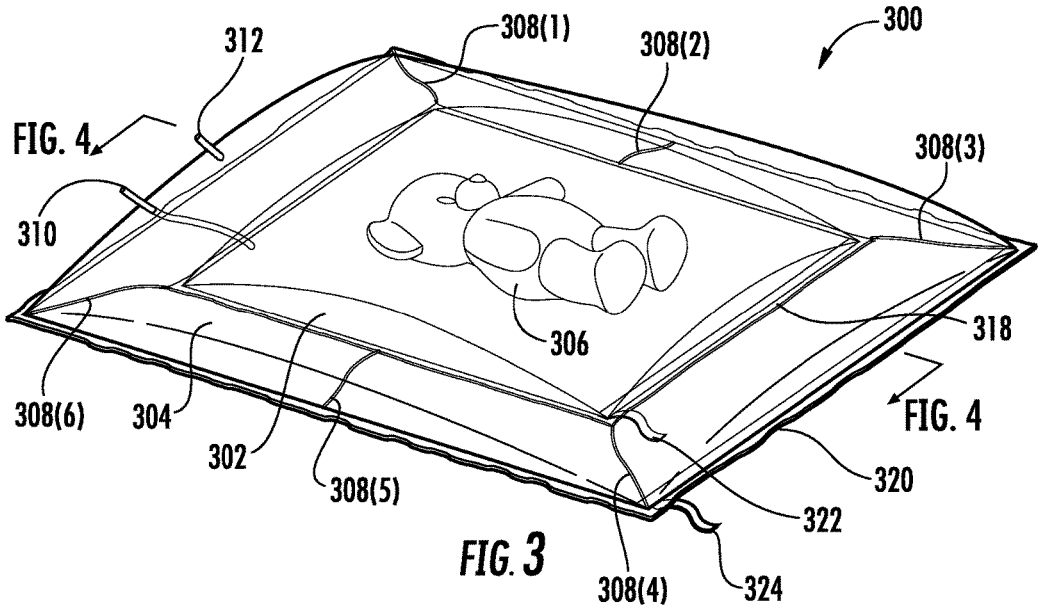
FIG. 3 illustrates a multi-chamber packaging device, in accordance with at least one example.
Figure 4:
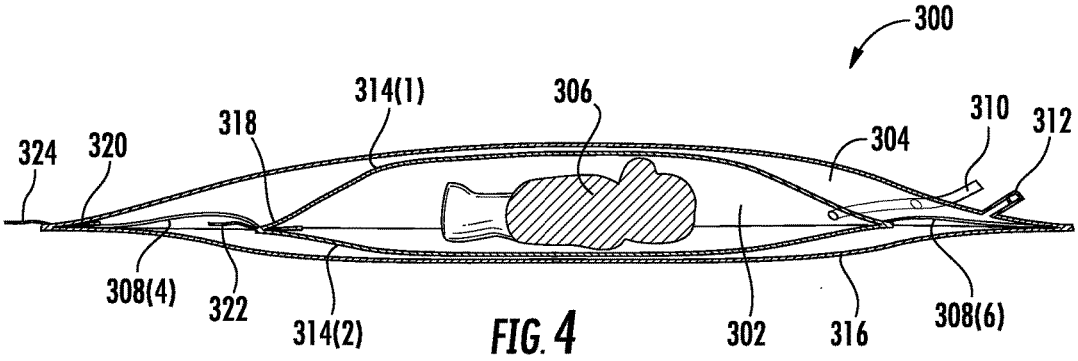
FIG. 4 illustrates a profile view of the multi-chamber packaging device of FIG. 3, in accordance with at least one example.

FIG. 3 and FIG. 4. illustrate a multi-chamber packaging device 300, in accordance with at least one example. The multi-chamber packaging device 300 can have a rectangular or cubic shape. In some examples, the multi-chamber packaging device 300 can have some other uniform shape (e.g., spherical, triangular, etc.) or non-uniform shape. The multi-chamber packaging device 300 can include an inner chamber 302 and an outer chamber 304. The inner chamber 302 may be dimensioned to receive an item 306. The multi-chamber packaging device 300 can also include one or more retention elements 308(1)-308(*n*) to retain the inner chamber 302 at a fixed position within the outer chamber 304. The multi-chamber packaging device 300 can also include an inner valve 310 and an outer valve 312. The inner valve 310 may enable inflation and/or deflation of the inner chamber 302. The outer valve 312 may enable inflation and/or deflation of the outer chamber 304. In some examples, the multi-chamber packaging device 300 (or any of the other multi-chamber packaging devices described herein) may have air added or removed from the chambers 302, 304 using needle that penetrates the outer chamber 304 and/or the inner chamber 302. In some examples, the material used to form the chambers 302, 304 may be self-sealing such that once the needle is removed the material expands and fills up any hole left by the needle. In some examples, a hole clogging material may also be applied to the chambers 302, 304 at some point before, after, or during the time when the needle is in the hole. For example, the hole clogging material may be ejected from the needle as the needle is being pulled out of the hole.

The multi-chamber packaging device 300 may be formed around the item 306. For example, the inner chamber 302 may be formed from one or more inner sheets 314. When the inner chamber 302 is formed from two inner sheets 314(1), 314(2), the item 306 may be placed between the two inner sheets 314 and edges of the two inner sheets 314 may be brought together and sealed. In this manner, the inner chamber 302 may be formed. The inner chamber 302 (now formed from the two inner sheets 314) may be placed on a first outer sheet 316(1). A second outer sheet 316(2) may be placed on top of the inner chamber 302 and edges of the outer sheets 316 may be brought together and sealed. In some examples, a single inner sheet 314 may be used to form the inner chamber 302. Likewise, in some examples, a single outer sheet 316 may be used to form the outer chamber 304. At any suitable point in this process, the valves 310, 312 and the retention elements 308 may be installed in the multi-chamber packaging device 300.

In some examples, the multi-chamber packaging device 300 may be pre-formed. In this examples, the item 306 may be placed in the multi-chamber packaging device 300 after the multi-chamber packaging device 300 is formed. For example, the inner chamber 302 and the outer chamber 304 may be formed as previously described except that openings 318, 320 may be left in the inner chamber 302 and the outer chamber 304, respectively. The openings 318, 320 may be formed by not sealing all edges of the inner chamber 302 and the outer chamber 304 during manufacturing. Through the openings 318, 320, the item 306 may be placed in the inner chamber 302. The openings 318, 320 may then be sealed using any suitable technique. In some examples, the openings 318, 320 may be re-sealable and include plastic zippers similar to those plastic zippers that are common on sandwich bags. This may enable the multi-chamber packaging device 300 to be reused.

In some examples, instead of or in addition to plastic re-sealable zippers, the inner chamber 302 can include an opening device 322 and the outer chamber 304 can include an opening device 324. Each of the opening devices 322, 324 may function to open respective its chamber. For example, the opening devices 322, 324 may each include a pull string that when pulled tears or otherwise opens its respective chamber. The chambers 302, 304 may include weaker sections of material that may correspond to the opening devices 322, 324. In some examples, a single opening device may be included in the multi-chamber packaging device 300 and configured to open both chambers 302, 304 simultaneously. For example, the single opening device may include a pull tab accessible from outside the multi-chamber packaging device 300 that is connected to a set of pull strings corresponding to each of the chambers 302, 304.

Figure 5:
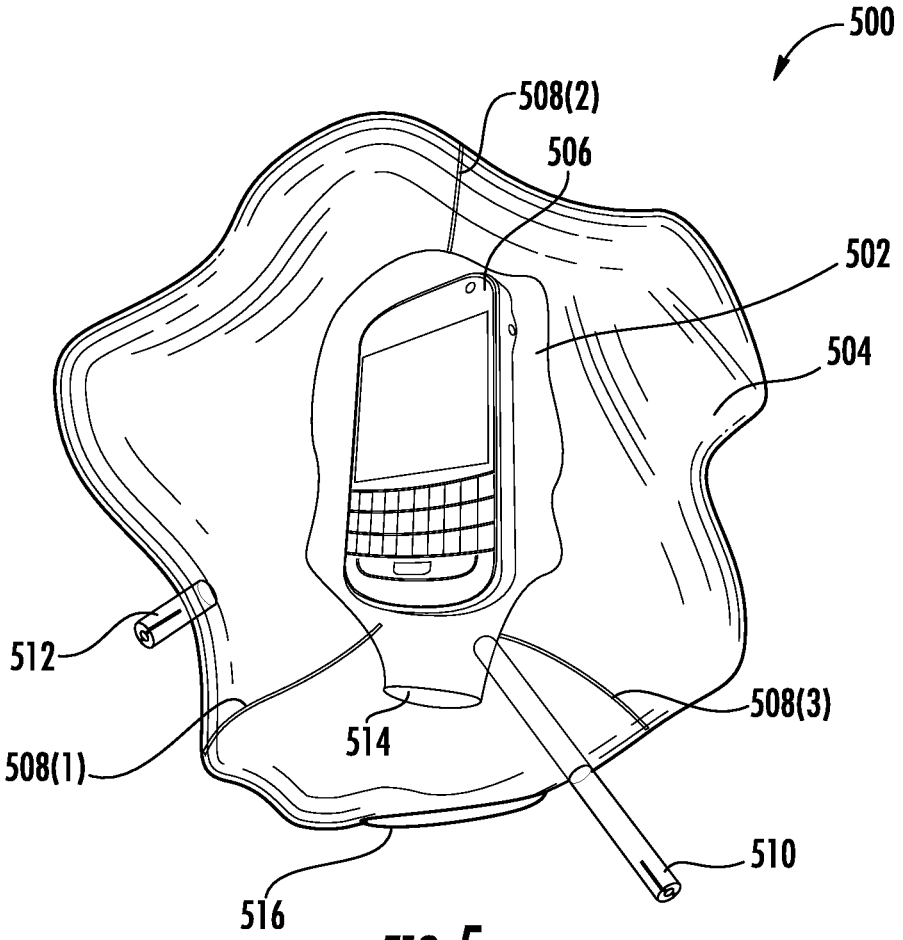
FIG. 5 illustrates a multi-chamber packaging device in a first state, in accordance with at least one example.
Figure 6:
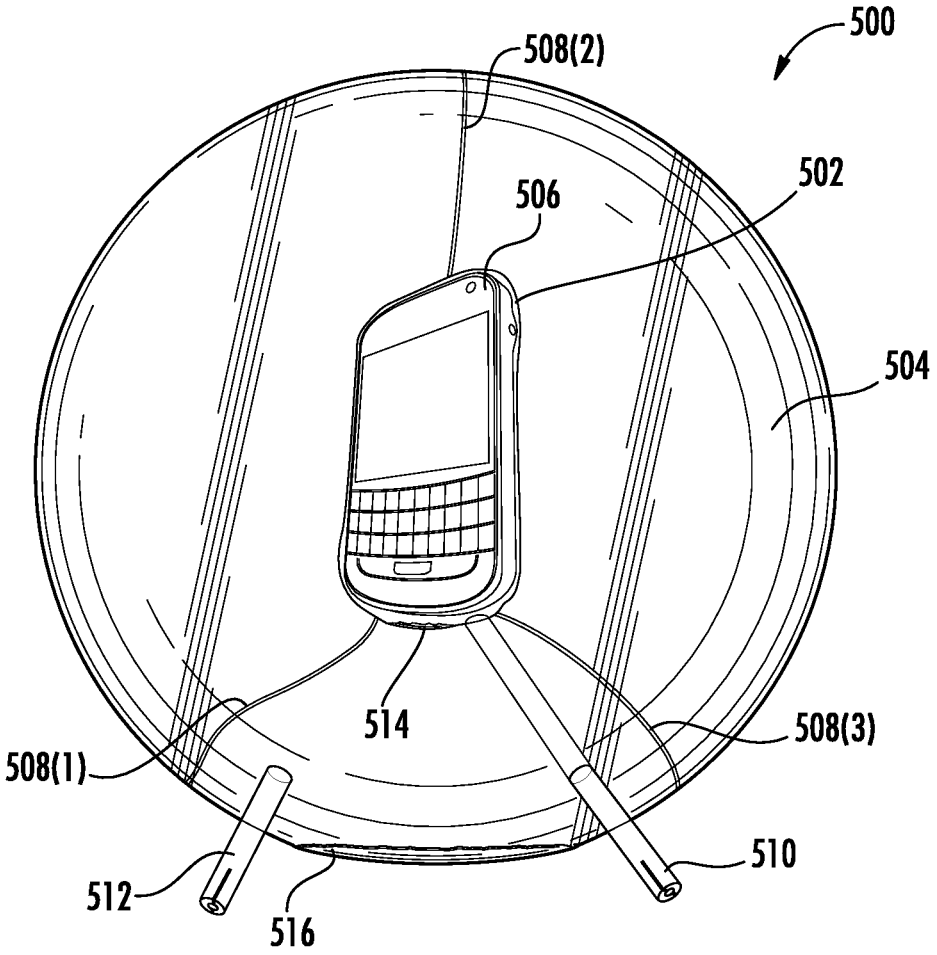
FIG. 6 illustrates the multi-chamber packaging device of FIG. 5 in a second state, in accordance with at least one example.

FIG. 5 and FIG. 6 illustrate a multi-chamber packaging device 500, in accordance with at least one example. In FIG. 5, the multi-chamber packaging device 500 is illustrated in an initial state prior to inflation or deflation of the multi-chamber packaging device 500. In FIG. 6, the multi-chamber packaging device 500 is illustrated in a final state after inflation and/or deflation of the multi-chamber packaging device 500 has taken place.

The multi-chamber packaging device 500 can have a spherical or other circle-like shape. In some examples, the multi-chamber packaging device 500 can have some other uniform shape (e.g., cubic, rectangular, triangular, etc.) or non-uniform shape. The multi-chamber packaging device 500 can include an inner chamber 502 and an outer chamber 504. The inner chamber 502 may be dimensioned to receive an item 506. The multi-chamber packaging device 500 can also include one or more retention elements 508(1)-508(*n*) to retain the inner chamber 502 at a fixed position within the outer chamber 504. The multi-chamber packaging device 500 can also include an inner valve 510 and an outer valve 512. The inner valve 510 may enable inflation and/or deflation of the inner chamber 502. The outer valve 512 may enable inflation and/or deflation of the outer chamber 504.

The inner chamber 502 may be formed from a single piece of flexible material and have an inner opening 514. For example, the inner chamber 502 may resemble a flexible bag having any suitable shape. In some examples, the inner opening 514 may be flexed open in order to allow the item 506 to pass through the inner opening 514. After the item 506 has been placed in the inner chamber 502, the inner opening 514 may be closed in any suitable manner. For example, the inner opening 514 may be tied, heat sealed, zipped, sewn, or otherwise closed.

The outer chamber 504 may be formed from a single piece of flexible material and have an outer opening 516. For example, the outer chamber 504 may resemble a slightly larger version of the inner chamber 502 (e.g., resemble a flexible bag having any suitable shape). In some examples, the outer opening 516 may be flexed open in order to allow the item 506 to pass through the outer opening 516. After the item 506 has been placed in the inner chamber 502, the outer opening 516 maybe closed in any suitable manner such as those methods discussed with reference to closing the inner opening 514. The multi-chamber packaging device 500 may also include opening devices to enable access to the item 506 by opening the chambers 502, 504.

As illustrated in FIG. 6, the inner chamber 502 may be deflated around the item 506. In this manner interior walls of the inner chamber 502 may retain the item 506 in a fixed position within the inner chamber 502. The outer chamber 504 may be inflated, with the inner chamber 502 remaining within. This may enable the outer chamber 504 to provider cushioning for the item 506.

Figure 7:
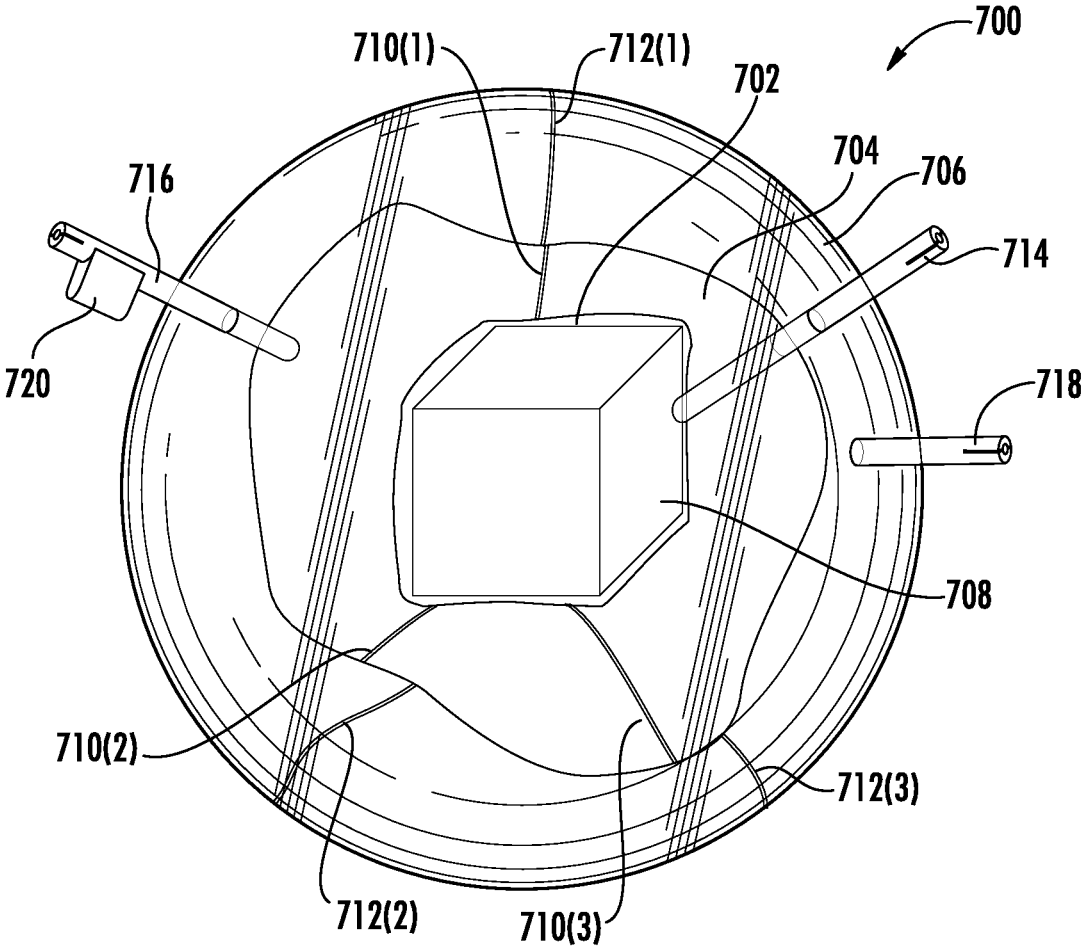
FIG. 7 illustrates a multi-chamber packaging device, in accordance with at least one example.

FIG. 7 illustrates a multi-chamber packaging device 700, in accordance with at least one example. The multi-chamber packaging device 700 can have a rectangular or cubic shape. In some examples, the multi-chamber packaging device 700 can have some other uniform shape (e.g., spherical, triangular, etc.) or non-uniform shape. The multi-chamber packaging device 700 can include an inner chamber 702, an intermediate chamber 704, and an outer chamber 706. The inner chamber 702 may be dimensioned to receive an item 708. The multi-chamber packaging device 700 can also include a first set of retention elements **710(1)-710(*n*) to retain the inner chamber 702 at a fixed position within the intermediate chamber 704. The multi-chamber packaging device 700 can also include a second set of retention elements 712(1)-712(*n*) to retain the intermediate chamber 704 within the outer chamber 706. The multi-chamber packaging device can also include an inner valve 714, an intermediate valve 716, and an outer valve 718. The inner valve 714 may enable inflation and/or deflation of the inner chamber 702. The intermediate valve 716 may enable inflation and/or deflation of the intermediate chamber 704. The outer valve 718 may enable inflation and/or deflation of the outer chamber 706**.

In some examples, the intermediate valve 716 may also include an inflation device 720. The inflation device 720 may include an air source (e.g., a compressed gas cylinder), that when opened, inflates the intermediate chamber 704. For example, the multi-chamber packaging device 700 may be used during execution of a delivery process using an unmanned aerial vehicle (UAV). The multi-chamber packaging device 700 may be placed in a stowage hold of the UAV. Once within the stowage hold, the outer chamber 706 may be inflated such that an exterior surface of the outer chamber 706 contacts two or more walls of the stowage hold. The compression between the outer chamber 706 and the walls of stowage hold may be adequate to hold the multi-chamber packaging device 700 in the stowage hold while the UAV transports the multi-chamber packaging device 700. As part of executing delivery of the multi-chamber packaging device 700, the outer chamber 706 may be deflated such that compression forces between the outer chamber 706 and the walls are reduced. This may enable the multi-chamber packaging device 700 to be removed and/or fall out of the stowage hold. In order to provide for a cushioned landing for the multi-chamber packaging device 700, as the multi-chamber packaging device 700 is falling to the ground or slightly before it is released by the UAV, the inflation device 720 may be triggered to inflate the intermediate chamber 704. This may be done automatically using mechanical methods (e.g., a string rip cord attached to the inflation device 720 that is pulled as the multi-chamber packaging device 700 is dropped) or using any other suitable method (e.g., an electric signal may be sent to the inflation device 720 to cause it to release the compressed gas). In this manner, when the multi-chamber packaging device 700 finally lands on the ground, the intermediate chamber 704 will be inflated and will cushion the item 708. The multi-chamber packaging device 700, including the inflation device 720, may also be used in situations other than delivery of items using UAVs. In some examples, a multi-chamber packaging device including two chambers may be used in this example. For example, the outer chamber 706 may be deflated as part of removing the device from the stowage hold and re-inflated, automatically or otherwise, prior being delivered to a recipient.

Figure 8:
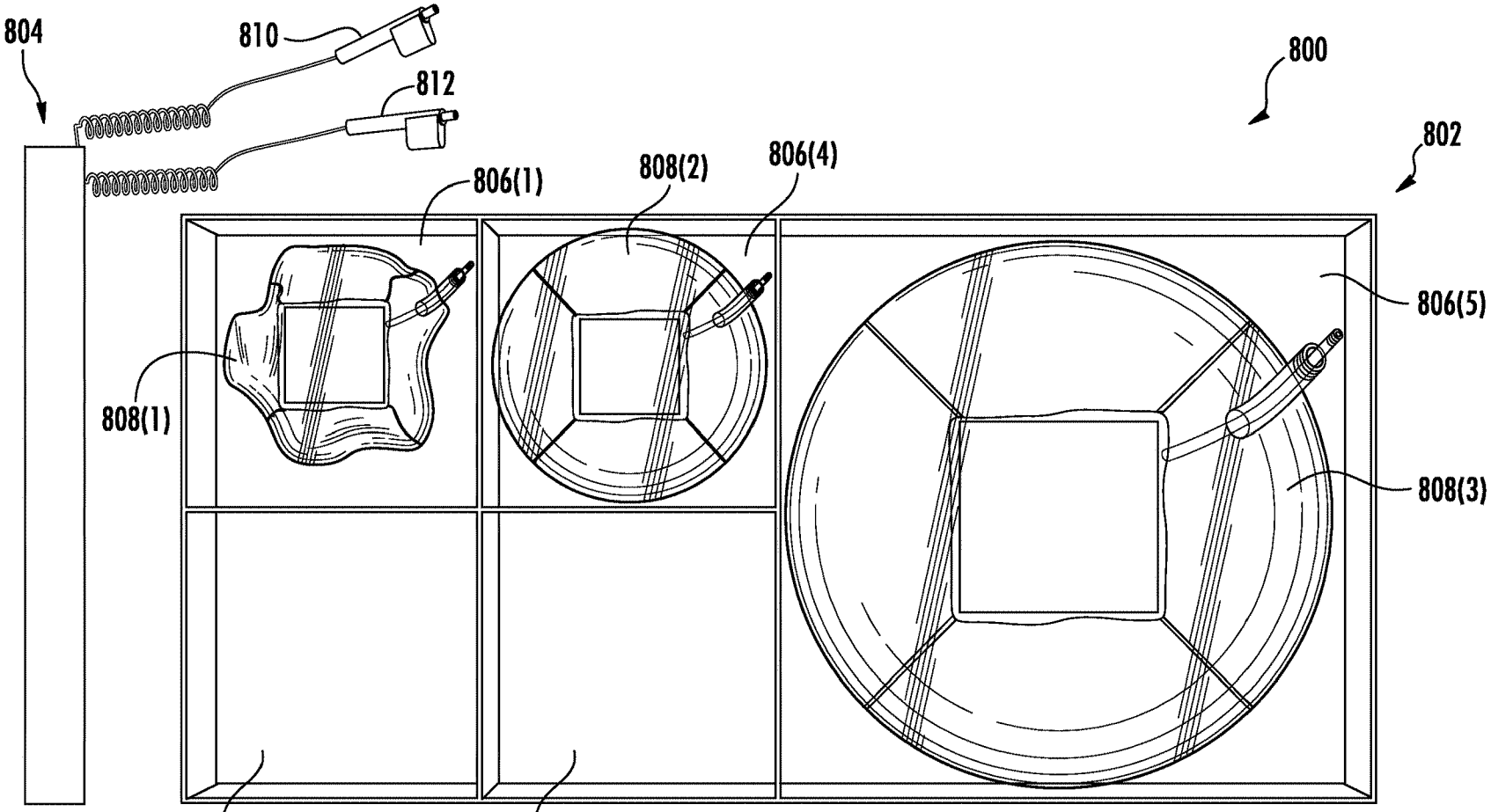
FIG. 8 illustrates a storage system including multi-chamber packaging devices, in accordance with at least one example.

FIG. 8 illustrates a storage system 800 for use in connection with multi-chamber packaging devices, in accordance with at least one example. The storage system 800 (or multiple storage systems 800) may be included in a shipping vehicle, a warehouse, a storage facility, an inventory processing/sorting facility, or at any other suitable location where items are stored, processed, shipped, or otherwise handled. The storage system 800 can include a storage or holding structure 802 and a gas station 804. The storage structure 802 can include a plurality of compartments **806(1)-806(*n*). The compartments 806 may be accessible from one or more horizontal sides of the compartment 806. In some examples, the compartments 806 may be accessible from the top of the compartments 806. In some examples, the compartments 806 may include a set of drawers or bins that are held within the storage structure 802**. To access objects in the drawers, the drawers may be pulled out and accessed through openings at the top of the drawers.

Each compartment 806 may be configured to receive one or more multi-chamber packaging devices 808. For example, the compartment 806(5) may be dimensioned to receive the large multi-chamber packaging device 808(3), while the compartment 806(1) may be dimensioned to receive the smaller multi-chamber packaging device 808(1).

The gas station 804 may include an inflation device 810 (e.g., an inflation chuck) and a deflation device 812 (e.g., a deflation chuck). The inflation device 810 and the deflation device 812 may include any suitable adaptor to connect to any suitable valve. The inflation device 810 may be configured to inflate chambers of the multi-chamber packaging devices 808. The deflation device 812 may be configured to deflate chambers of the multi-chamber packaging devices 808. In some examples, the function of inflation and deflation may be included in a single device at the gas station 804.

The devices 810, 812 may include the appropriate structures to attach to the valves of the multi-chamber packaging devices 808.

The inflation device 810 may be connected to a gas chamber of a compressor via a hose. The inflation device 810 may be used to transfer compressed air (or other gas) from the gas chamber to the multi-chamber packaging devices 808 in a controllable manner. Thus, in some examples, the inflation device 810 may include a pressure regulator or other suitable device to regulate gas being forced into the multi-chamber packaging devices 808.

The deflation device 812 may be connected to a vacuum or other suitable device configured to remove gas from the multi-chamber packaging devices 808 in a controllable manner. In some examples, the deflation device 812 is used to equalize pressure between the multi-chamber packaging device 808 and the atmosphere without actually creating negative pressure in the multi-chamber packaging device 808. In some examples, however, the deflation device 812 is used to create negative pressure or a vacuum in the multi-chamber packaging device 808. This may function to retain the items within the multi-chamber packaging devices 808.

As introduced above, the storage system 800 may be included in a shipping vehicle. For example, the storage structure 802 may installed along opposite walls of a box enclosure of the shipping vehicle. The gas station 804 may be installed in the shipping vehicle so as to reach each compartment 806 of the storage structure 802. The multi-chamber packaging devices 808 may be provided to the shipping vehicle with their outer compartments deflated. The multi-chamber packaging devices 808 may be placed in to the compartments 806 and the inflation device 810 may be used to inflate the outer chambers. For example, the multi-chamber packaging devices 808(2), 808(3) are illustrated as having their outer chambers inflated. When the outer chambers are inflated in the compartments 806, the walls of the outer chambers contact the walls of the compartment 806 and hold the multi-chamber packaging devices 808 in the compartments 806. When it is time to delivery one of the multi-chamber packaging devices 808 (e.g., as part of a delivery process to a customer), the deflation device 812 may be used to deflate the outer chamber. For example, the multi-chamber packaging device 808(1) is illustrated as having its outer chamber deflated. In this state, the multi-chamber packaging device 808(1) may be easily removed from the compartment 806(1) and delivered to the customer. In some examples, prior to delivery of the multi-chamber packaging device 808(1) to the customer, the inflation device 810 may again be used to inflate the outer chamber of the multi-chamber packaging device 808(1). This may provide cushioning for the item (in the multi-chamber packaging device 808(1)) while the multi-chamber packaging device 808(1) is carried to the customer's delivery location and while the multi-chamber packaging device 808(1) sits at the customer's delivery location.

Figure 9:
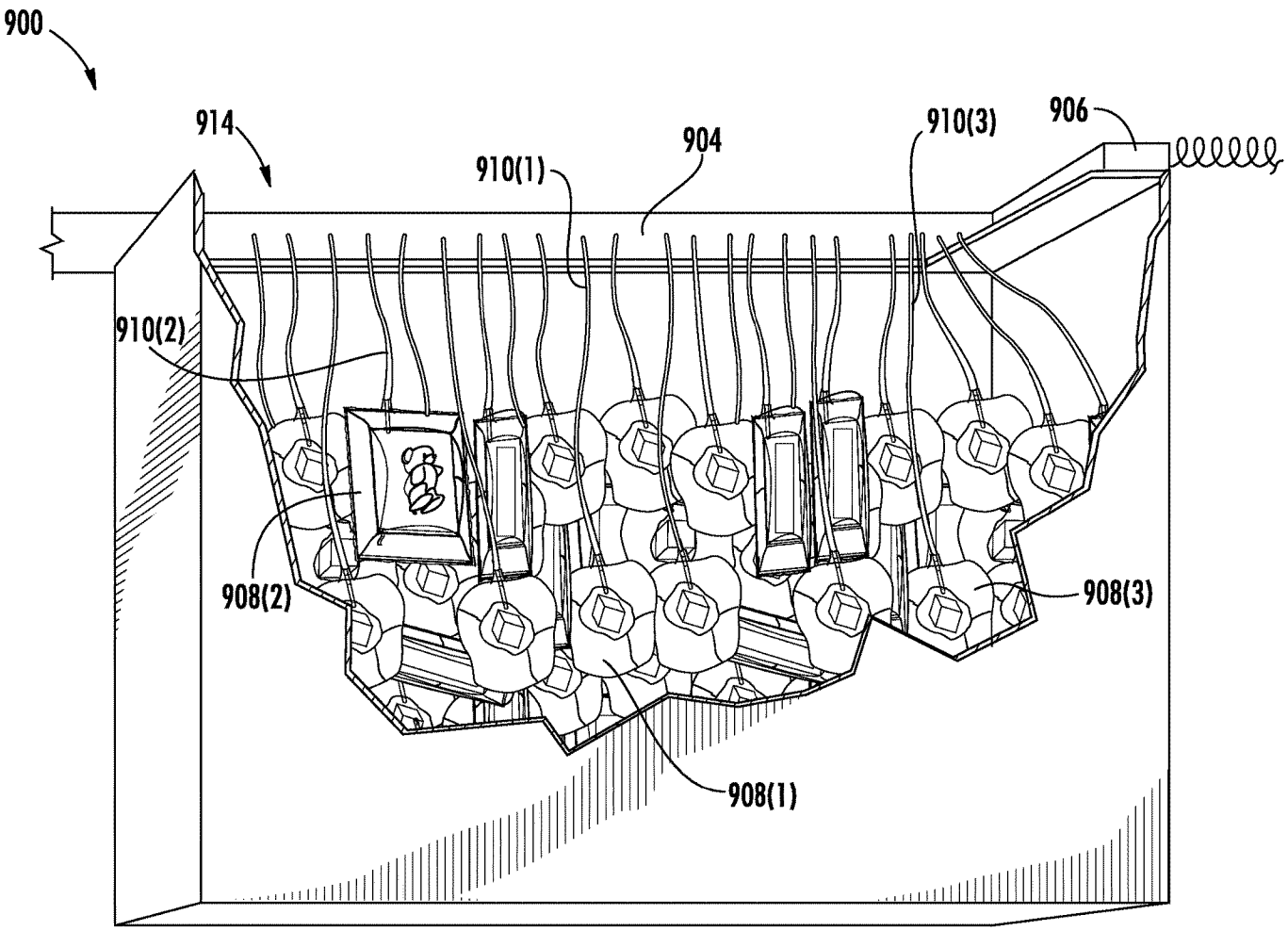
FIG. 9 illustrates a storage system including multi-chamber packaging devices, in accordance with at least one example.
Figure 10:
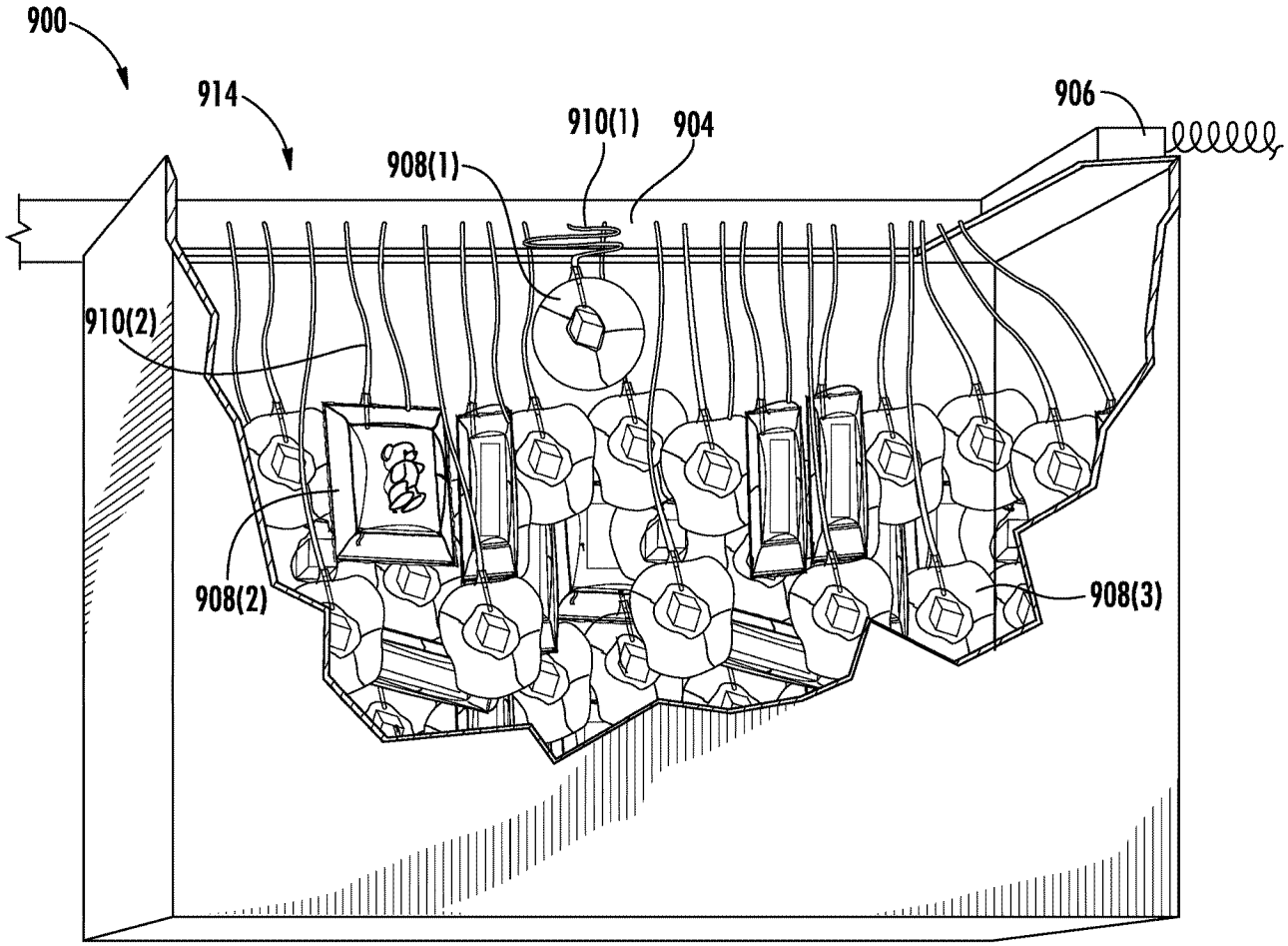
FIG. 10 illustrates the storage system of FIG. 9 including multi-chamber packaging devices, in accordance with at least one example.

FIGS. 9 and 10 illustrate a storage system 900 for use in connection with multi-chamber packaging devices, in accordance with at least one example. The storage system 900 (or multiple storage systems 900) may be included in a shipping vehicle, a warehouse, a storage facility, an inventory processing/sorting facility, or at any other suitable location where items are stored, processed, shipped, or otherwise handled. The storage system 900 can include a storage bin 902, a gas manifold 904, and a gas handling device 906.

The storage bin 902 can be configured to retain a plurality of multi-chamber packaging devices 908 therein. In FIG. 9, the multi-chamber packaging devices 908 are illustrated in a storage state in which inner chambers and outer chambers are deflated. In some examples, the inner chambers may be vacuum sealed around the items and the outer chambers may have pressures equal to the atmosphere surrounding the storage bin 902. In FIG. 9, an outer chamber of a particular multi-chamber packaging device 908(1) has been inflated. As described in detail herein, this may cause the multi-chamber packaging device 908(1) to move to an upper portion of the storage bin 902, at least above some of the other multi-chamber packaging devices 908.

The storage bin 902 may have an opening 914 along a top side. Through the opening 914 the multi-chamber packaging devices 908 may be placed into the storage bin 902. The gas manifold 904 may include a plurality of gas hoses 910 which can be connected to the multi-chamber packaging devices 908 when the multi-chamber packaging devices 908 are placed in the storage bin 902. In particular, each gas hose 910 may be connected to at least an outer valve on each of the multi-chamber packaging devices 908. In some examples, each gas hose 910 may be associated with the multi-chamber packaging device 908. For example, each gas hose 910 may have a unique identifier (e.g., unique as to the other hoses 910 in the storage bin 902 and/or unique as to other hoses 910 in a system that includes multiple storage bins) and each multi-chamber packaging device 908 may have a unique identifier. When an operator places a multi-chamber packaging device 908 (e.g., the multi-chamber packaging device 908(2)) in the storage bin 902, the operator may scan a barcode on the multi-chamber packaging device 908(2) that includes information about its unique identifier. The operator may also scan a barcode on the gas hose 910(2) that includes information about its unique identifier. The scanned information may be saved in a database or other storage structure associated with an inventory management system that manages the multi-chamber packaging devices 908 in the storage bins 902.

The gas handling device 906 may be configured to add and/or remove gas from individual multi-chamber packaging devices 908 that are connected to the gas manifold 904 via the hoses 910. For example, as illustrated in FIG. 10, if an order is received that indicates that an item held within the multi-chamber packaging device 908(1) has been purchased by a user, an inventory management system (e.g., one or more computers that manage inventory) may instruct the gas handling device 906 to inflate the multi-chamber packaging device 908(1). This may be achieved as pressurized gas is directed by the gas handling device 906 via the manifold 904 and down the gas hose 910(1) that is connected to the outer chamber of the multi-chamber packaging device 908(1).

In some examples, inflating the outer chamber of the multi-chamber packaging device 908(1) may increase the surface area of the multi-chamber packaging device 908(1), which may increase its buoyancy as compared to the other multi-chamber packaging devices 908. This alone may cause the multi-chamber packaging device 908(1) to rise towards the top of the storage bin 902. In some examples, the storage bin 902 may be transportable (e.g., may be connected to a mobile drive unit that moves the storage bin 902 throughout a warehouse). As the mobile drive unit transports the storage bin 902, movement of the multi-chamber packaging devices 908 may cause the multi-chamber packaging device 908(1) to rise above the other multi-chamber packaging devices 908. The fact that the multi-chamber packaging device 908(1) is inflated, while the others may be deflated or less inflated, and the fact that it is located near the top of the pile of multi-chamber packaging devices 908, may make it easily identifiable by an operator who is tasked with removing the multi-chamber packaging device 908(1). Thus, instead of having to dig through the pile of multi-chamber packaging devices 908 to find the multi-chamber packaging device 908(1), the multi-chamber packaging device 908(1) may have automatically been moved to the top of the multi-chamber packaging devices 908.

In some examples, the multi-chamber packaging device 908(1) may be inflated with a gas that is buoyant in air (e.g., hot air, methane, helium, hydrogen, and any other similar gas). This may assist in lifting the multi-chamber packaging device 908(1) from inside the storage bin 902 to the top of the multi-chamber packaging devices 908. In some examples, the multi-chamber packaging device 908(1) may be inflated with a lighter-than-air gas and allowed to float outside of the storage bin 902. For example, after the multi-chamber packaging device 908(1) had been inflated, the gas hose 910(1) may be disconnected, and the multi-chamber packaging device 908(1) may be allowed to float out of the storage bin 902 through the opening 914 of the storage bin 902. The multi-chamber packaging device 908 (1) may float up to a conveyor system located on the ceiling of the building in which the storage system 900 is located. The conveyor system may collect the multi-chamber packaging device 908(1) and other multi-chamber packaging devices and move them to a location where they may be further processed. In some examples, the conveyor system may include a series of fans to blow the multi-chamber packaging device 908(1) and other multi-chamber packaging devices 908. In some examples, a pipe or chimney may be placed above the storage bin 902 such that the multi-chamber packaging device 908(1) floats up the chimney to intersect with the conveyor system.

The valves of the multi-chamber packaging devices described herein may be uniquely sized or otherwise be distinguishable from each other (e.g., color coding, texture, etc.). In this manner, it may be easy for an operator to select a particular valve (e.g., inner valve or outer valve). In some examples, the valves may include a magnetic region in order to quickly and efficiently attach the valves to a filler device. In some examples, the gases used to inflate the multi-chamber packaging devices 908 may have particular colors (e.g., artificially enhanced or naturally occurring). When the walls of the multi-chamber packaging devices 908 are transparent or at least translucent, the user of colored gases may be helpful to distinguish certain multi-chamber packaging devices 908 from others. For example, the multi-chamber packaging device 908(1) may be filled with a red-colored gas. This may enable an operator to more easily identify the multi-chamber packaging device 908(1) from among the others.

Figure 11:
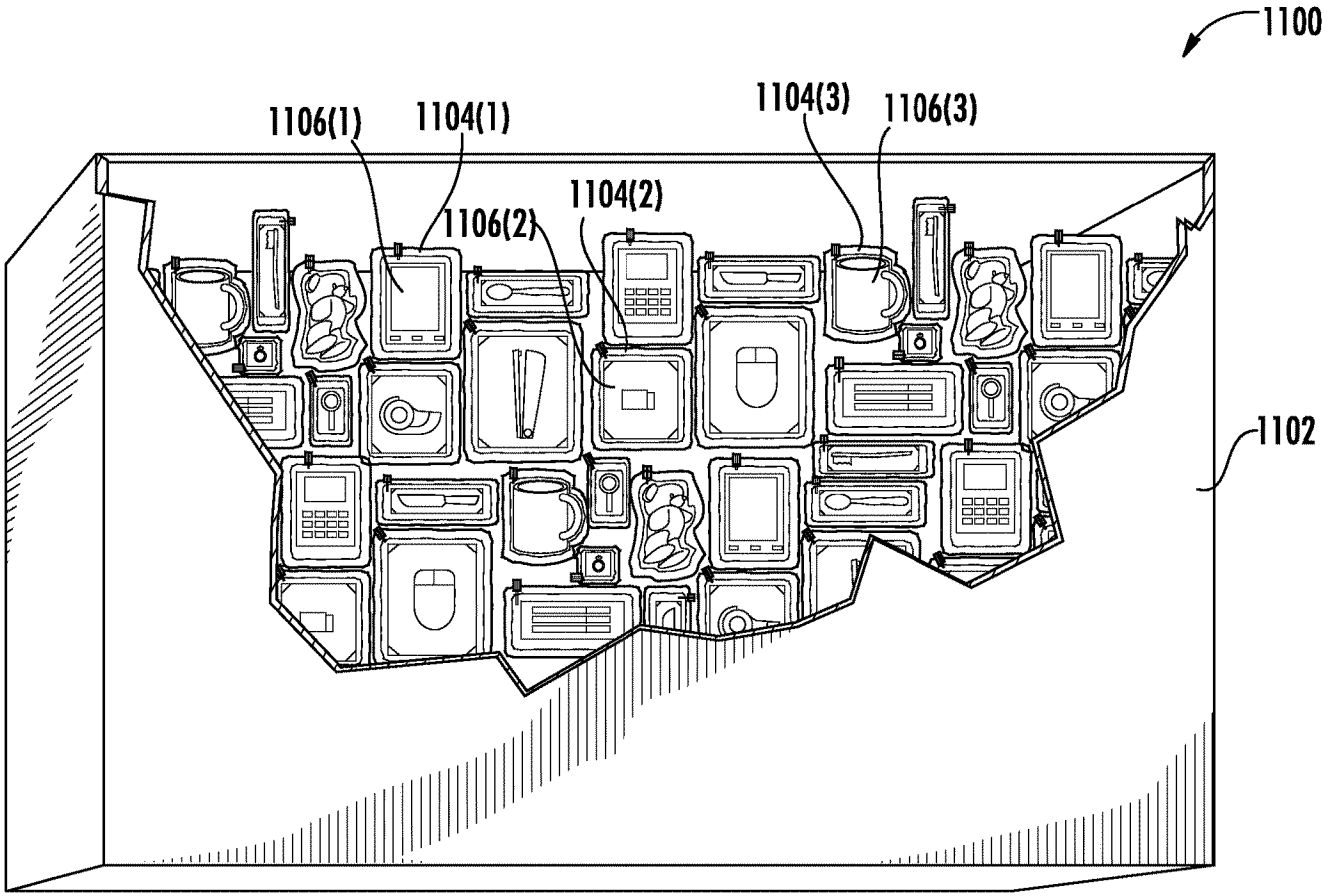
FIG. 11 illustrates a storage system including multi-chamber packaging devices, in accordance with at least one example.

FIG. 11 illustrates a storage system 1100 for use in connection with multi-chamber packaging devices, in accordance with at least one example. The storage system 1100 (or multiple storage systems 1100) may be included in a shipping vehicle, a warehouse, a storage facility, an inventory processing/sorting facility, or at any other suitable location where items are stored, processed, shipped, or otherwise handled.

The storage system 1100 includes a storage bin 1102. The storage bin 1102 may be configured to receive multiple multi-chamber packaging devices 1104 which each hold one or more items 1106. In the storage system 1100, both chambers of the multi-chamber packaging devices 1104 (e.g., inner chambers and outer chambers) are deflated or otherwise have had the gas drawn out of them. This allows the chambers to flexibly extend around the items 1106, conform around the items 1106 to retain the items 1106, and otherwise be situated in a compact state. In this state, the multi-chamber packaging devices 1104 not only function to retain the items 1106, but do so in very space efficient manner. This is especially true when compared to traditional packing techniques that use boxes or other bulky items to retain the individual items 1106. Thus, use of the multi-chamber packaging devices 1104 in the storage system 1100 (or other storage systems described herein) may result in a more dense packing configuration over these traditional techniques because boxes and other bulky items, which inefficiently require a great deal of extra space in the storage bin 1102, may not be required.

As illustrated in FIG. 11, the multi-chamber packaging devices 1104 may include some items that are within their own product packaging and some items that are not within any product packaging. For example, the item 1106(1) (e.g., a tablet device) and the item 1106(3) (e.g., a coffee mug) may be included directly within the multi-chamber packaging devices 1104(1), 1104(3), respectively (e.g., no product packaging). The item 1106(2) (e.g., an SD card) may be included in its own product packaging (e.g., a square shaped plastic package), which may be placed within the multi-chamber packaging device 1104(2). In either case, use of the multi-chamber packaging devices 1104 may eliminate the need for additional packing materials, which may result in significant cost for those entities that store, ship, or otherwise process the items 1106. These cost savings may be a result of additional volume in the storage bin 1102 being allocatable to actual product instead of to packing materials, a reduction of weight because packing materials have been eliminated, a reduction or elimination of costs associated with the purchase of packing materials, a reduction in labor costs attributable to packing and/or unpacking items in traditional packing materials, a reduction in customer complaints and/or returns attributable to difficulty of opening traditional packing materials, and other similar costs as compared to traditional packing techniques.

In some examples, the multi-chamber packaging devices 1104 may be inflated and deflated multiple times over the life of the multi-chamber packaging devices 1104. For example, as illustrated in FIG. 11, both chambers of the multi-chamber packaging devices 1104 may be deflated. After removing the multi-chamber packaging device 1104 (1) from the storage bin 1102, an outer chamber of the multi-chamber packaging device 1104(1) may be inflated to cushion the item 1106(1). If the multi-chamber packaging device 1104(1) is being used in an item delivery process, the outer chamber may stay inflated as the multi-chamber packaging device 1104(1) (and the item 1106(1)) is delivered to a user (e.g., left at a delivery location). In some examples, the outer chamber may be deflated and the multi-chamber packaging device 1104(1) may be placed in a compartment such as one of the compartments 806. Once within the compartment, the outer chamber may again be inflated to retain the multi-chamber packaging device 1104(1) within the compartment through contact between the multi-chamber packaging device 1104(1) and inner walls of the compartment. To remove the multi-chamber packaging device 1104(1) from the compartment, the outer chamber may again be deflated. In some examples, the inner chamber and/or the outer chamber may be inflated and deflated additional times for other reasons other than those explicitly described herein.

It is understood that multi-chamber packaging devices 100, 300, 500, 700, 808, 908, and 1104 are examples of each other. Thus, the features described with reference to one multi-chamber packaging device may also be included in one of the other multi-chamber packaging devices and vice versa.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the disclosure to the specific form or forms disclosed, but on the contrary, the intention is to cover all modifications, alternative constructions, and equivalents falling within the spirit and scope of the disclosure, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

Recitation of ranges of values herein are merely intended to serve as a shorthand method of referring individually to each separate value falling within the range, unless otherwise indicated herein and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the disclosure and does not pose a limitation on the scope of the disclosure unless otherwise claimed. No language in the specification should be construed as indicating any non-claimed element as essential to the practice of the disclosure.

Disjunctive language such as the phrase "at least one of X, Y, or Z," unless specifically stated otherwise, is intended to be understood within the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Preferred embodiments of this disclosure are described herein, including the best mode known to the inventors for carrying out the disclosure. Variations of those preferred embodiments may become apparent to those of ordinary skill in the art upon reading the foregoing description. The inventors expect skilled artisans to employ such variations as appropriate and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A device, comprising:

a cushion chamber formed from a flexible material;

a first valve extending from within the cushion chamber to outside the cushion chamber, the first valve configured to enable inflation of the cushion chamber and deflation of the cushion chamber;

a retention chamber formed from the flexible material, the retention chamber:

disposed within the cushion chamber; and dimensioned to receive one or more items as part of an item delivery process; and a second valve concentric with and disposed within the first valve and extending from within the retention chamber to outside the cushion chamber, the second valve configured to at least enable deflation of the retention chamber;

wherein, after an item has been placed in the retention chamber:

the second valve is used to remove first air from the retention chamber to deflate the retention chamber to securely hold the item during execution of the item delivery process; and the first valve is used to add second air to the cushion chamber to inflate the cushion chamber to cushion the item during execution of the item delivery process.

2. The device of claim 1, wherein removing the first air from the retention chamber forms a vacuum in the retention chamber that causes walls of the retention chamber to conform around the item.

3. The device of claim 1, wherein the retention chamber is held at a fixed position with respect to the cushion chamber via one or more retention elements.

4. The device of claim 3, wherein the one or more retention elements comprise at least one of one or more cords connecting the retention chamber and the cushion chamber or one or more webs connecting inner surfaces of the cushion chamber with inner surfaces of the retention chamber.

5. The device of claim 1, further comprising a first opening disposed in the cushion chamber and a second opening aligned with the first opening and disposed in the retention chamber, the first valve being formed at least partially in the first opening and the second valve being formed at least partially in the second opening.

6. A device, comprising:

a first chamber formed from a flexible material;

a first tube extending from within the first chamber to outside the first chamber, the first tube configured to at least enable addition of gas to the first chamber;

a second chamber formed from the flexible material, the second chamber:

disposed within the first chamber; and dimensioned to receive one or more items; and a second tube concentric with and disposed within the first tube and extending from within the second chamber to outside the first chamber, the second tube configured to at least enable removal of gas from the second chamber.

7. The device of claim 6, wherein the flexible material comprises rubber, latex, polyester, biaxially-oriented polyethylene terephthalate, nylon, foil, or plastic.

8. The device of claim 6, wherein:

the flexible material comprises a first flexible material and a second flexible material; and the first chamber is formed from the first flexible material and the second chamber is formed from the second flexible material.

9. The device of claim 6, wherein each of the first tube and the second tube comprises a valve.

10. The device of claim 6, wherein the second chamber is held at a fixed position with respect to the first chamber via one or more retention elements.

11. The device of claim 6, wherein:

the device is dimensioned to fit within an opening of a holding structure; and inflation of the first chamber causes an exterior surface of the first chamber to contact an interior surface of the holding structure.

12. The device of claim 6, further comprising an integrated opening device for opening the first chamber and the second chamber.

13. The device of claim 6, further comprising a first opening disposed in the first chamber and a second opening disposed in the second chamber, the first opening and the second opening being dimensioned to receive the one or more items.

14. The device of claim 6, further comprising a third chamber, the second chamber disposed within the third chamber, with the third chamber disposed within the first chamber.

15. The device of claim 14, wherein the third chamber is inflatable independent of the first chamber and the second chamber.

16. The device of claim 6, wherein the first chamber comprises a delivery label attached to an exterior surface of the first chamber, the delivery label including instructions relating to execution of an item delivery process.

17. A method, comprising:

providing an item inside an inner chamber of a delivery package, the delivery package formed from a flexible material and comprising an outer chamber, with the inner chamber positioned within the outer chamber;

removing a first gas from the inner chamber through a first tube to collapse the inner chamber around the item to securely hold the item; and adding a second gas to the outer chamber through a second tube to inflate the outer chamber to cushion the item, wherein the first tube is concentric with and disposed within the second tube.

18. The method of claim 17, wherein adding the second gas to the outer chamber comprises adding the second gas via a needle.

19. The method of claim 17, further comprising:

removing at least a portion of the second gas from the outer chamber;

placing the delivery package in a holding structure; and adding a third gas to the outer chamber to inflate the outer chamber within the holding structure.

20. The method of claim 17, wherein removing the first gas from the inner chamber creates a vacuum in the inner chamber.

* * * * *